US007861758B2

(12) United States Patent
Sun

(10) Patent No.: US 7,861,758 B2
(45) Date of Patent: Jan. 4, 2011

(54) PUSH-BUTTON CONTROLLED CORRECTION TAPE

(75) Inventor: David Sun, Taipei Hsieh (TW)

(73) Assignee: Leone Penna Co., Ltd., Hsin-Tien, Taipei Hsieh (TW)

( * ) Notice: Subject to any disclaimer, the term of this patent is extended or adjusted under 35 U.S.C. 154(b) by 303 days.

(21) Appl. No.: 12/285,201

(22) Filed: Sep. 30, 2008

(65) Prior Publication Data

US 2009/0159217 A1 Jun. 25, 2009

(30) Foreign Application Priority Data

Dec. 19, 2007 (TW) ..... 96221607 U

(51) Int. Cl.

| | |
|---|---|
| ***B44C 7/00*** | (2006.01) |
| ***E04D 15/00*** | (2006.01) |
| ***B29C 65/00*** | (2006.01) |
| ***B32B 37/00*** | (2006.01) |
| ***G05G 15/00*** | (2006.01) |
| ***B65H 37/00*** | (2006.01) |

(52) U.S. Cl. ..... 156/574; 156/577; 156/579; 156/349; 156/538; 156/539; 156/540

(58) Field of Classification Search ..... 156/574, 156/577, 579, 349, 538, 539, 540
See application file for complete search history.

(56) References Cited

U.S. PATENT DOCUMENTS

| | | | | |
|---|---|---|---|---|
| 2008/0173406 | A1* | 7/2008 | Wu | 156/540 |
| 2009/0229763 | A1* | 9/2009 | Lin | 156/577 |
| 2010/0108269 | A1* | 5/2010 | You | 156/577 |

* cited by examiner

*Primary Examiner*—Khanh Nguyen
*Assistant Examiner*—Matthew Hoover
(74) *Attorney, Agent, or Firm*—Bacon & Thomas, PLLC

(57) ABSTRACT

The present invention relates to a push-button controlled correction tape, comprising: a casing, which is provided with an accommodating space, as well as an upper covering, a lower covering, and an assembling covering; a tape holder, which is placed in the accommodating space of the casing, and is provided with a first assembly, a second assembly, a tape exporting device, and an applicator head, wherein the first assembly is provided with a pair of poles; a pressing mechanism, which is placed on one side of the rear coving of the casing, and is provided with a pressing portion, a guiding block and a sliding bar.

11 Claims, 8 Drawing Sheets

PUSH-BUTTON CONTROLLED CORRECTION TAPE

FIELD OF THE INVENTION

The present invention relates to a push-button controlled correction tape. More particularly, the present invention relates to a correction tape within which the applicator head would be able to extend outside, or recess into the casing.

BACKGROUND OF THE INVENTION

Most correction tapes generally comprise: a casing, an outer covering, and a tape exporting device, wherein the tape exporting device is placed in the casing with an applicator head sticking out of the casing. In order to prevent the coating side of the tape from dirt attachments, it is common to further cap the applicator head with a head covering to encase the applicator head. However, the method mentioned above would require the removal of the outer covering from the casing before use, and if the head covering happens to be lost, the tape on the applicator head would be stained by dirt. Therefore, such disadvantage is a problem yet to be solved.

SUMMARY OF THE INVENTION

The objective of the present invention is to provide a push-button controlled correction tape within which the applicator head would be able to extend outside, or recess into the casing.

Another objective of the present invention is to provide a push-button controlled correction tape prevented from damages or staining due to external impacts.

The push-button controlled correction tape of the present invention comprises: a casing, which is provided with an accommodating space, and the rear end of the casing is provided with an opening and a bulge, while the front end is provided with a circular opening; a tape holder, which is placed within the accommodating space of the casing, and an applicator head is provided at the front end, as well as a pair of posts at the rear end; and a pressing mechanism, which is placed on the opening of the rear end of the casing, and is provided with a pressing portion, a guiding block, and a sliding bar, wherein the pressing portion is provided with a receiving space, and a pair of receiving tubes are extended from the two ends of one side of the receiving space in order to receive the pair of posts at the rear end. In addition, the edge of one side of the pressing portion is provided with a pair of buckling holes, while a first guiding path is provided on the guiding block, and a pair of clippings corresponding to the buckling holes on the pressing portion is provided on one side of the guiding block in order to place the guiding block in the receiving space of the pressing portion. A notch is provided on one end of the sliding bar in order to receive the bulge of the casing, and a guiding bar is provided on the other end, within which the guiding bar of the sliding bar is moved to a preset position upon the pushing of the guiding block when the pressing portion is pushed, which forces the receiving tubes of the pressing portion to push the tape holder forwards, at this moment, the tape holder would experience a compression elastic force, so the applicator head would expose outside the circular opening of the casing.

The casing is further provided with an upper covering, a lower covering, and an assembling covering, wherein the circular opening is provided on the upper covering while the opening is provided on the assembling covering, and the bulge is provided on one side inside the assembling covering.

The front side of the lower covering is a blocked structure while the rear side is a semi-opened structure, and a buckling hole is provided on the rear side of the semi-opening structure.

The upper covering is placed on the upper end of the lower covering and assembles with the lower covering. The upper covering has an inverse U shape as well as being transparent, and a buckling hole is also provided on the position corresponding to the buckling hole on the lower covering.

In order to assemble the upper and the lower coverings, a pair of symmetrical clippings is provided on the positions on the assembling covering corresponding to the positions of the buckling holes on the upper and the lower coverings.

The tape holder is further provided with a first assembly, a second assembly, and a correction tape exporting device. The correction tape exporting device is fixed between the first assembly and the second assembly, and the applicator head is combined with the correction tape exporting device, while the pair of poles are placed on an arc surface, which is extended from one side of the rear side of the first assembly.

A plurality of pins are provided on the side of the first assembly, and a straight bar is provided on the front side, and the two sides of the straight bar each has a stopping portion. Holes are provided on top of the stopping portion, and an elastic element is provided inside the straight bar. The edges of the two ends on the arc surface are also provided with holes.

The positions on the second assembly corresponding to the plurality of pins on the first assembly are provided with holes, and positions corresponding to the holes of the stopping portion and the holes on the arc surface are also provided with pins.

The casing is provided with a lower covering, the front side of the lower covering is a blocked structure, and the two sides of the inner walls of the blocked structure are provided with a pair of symmetrically placed poles. The poles are used for holding the elastic element in position so within the pressing process, either a compression elastic force or an elasticity recovery force would be induced for the elastic element.

The pressing mechanism is further provided with a fixing block, which is provided with a plurality of poles, and the guiding block is provided with a plurality of through holes in order to fix the guiding bar by binding the fixing bock to the guiding block.

The guiding block of the pressing mechanism is further provided with a second guiding path. The second guiding path is used when the pressing portion is being pressed once again, as so the guiding bar of the sliding bar recesses back into the first guiding path along the second guiding path due to the pushing of the guiding block, and forces the receiving tubes to push the poles on the tape holder, which moves the tape holder forwards. At this moment, the tape holder would experience an elasticity recovery force, which causes the applicator head to recess back into the casing.

The push-button controlled correction tape of the present invention forces the applicator head to expose outside the circular opening of the casing by pushing the pressing portion, and by pushing the pressing portion once again, the applicator head would recess back into the casing. Therefore, the push-button controlled correction tape of the present invention would be prevented from damages or staining due to external impacts.

BRIEF DESCRIPTIONS OF THE DRAWINGS

DETAILED DESCRIPTION OF THE PREFERABLE EMBODIMENTS

Figure 1:
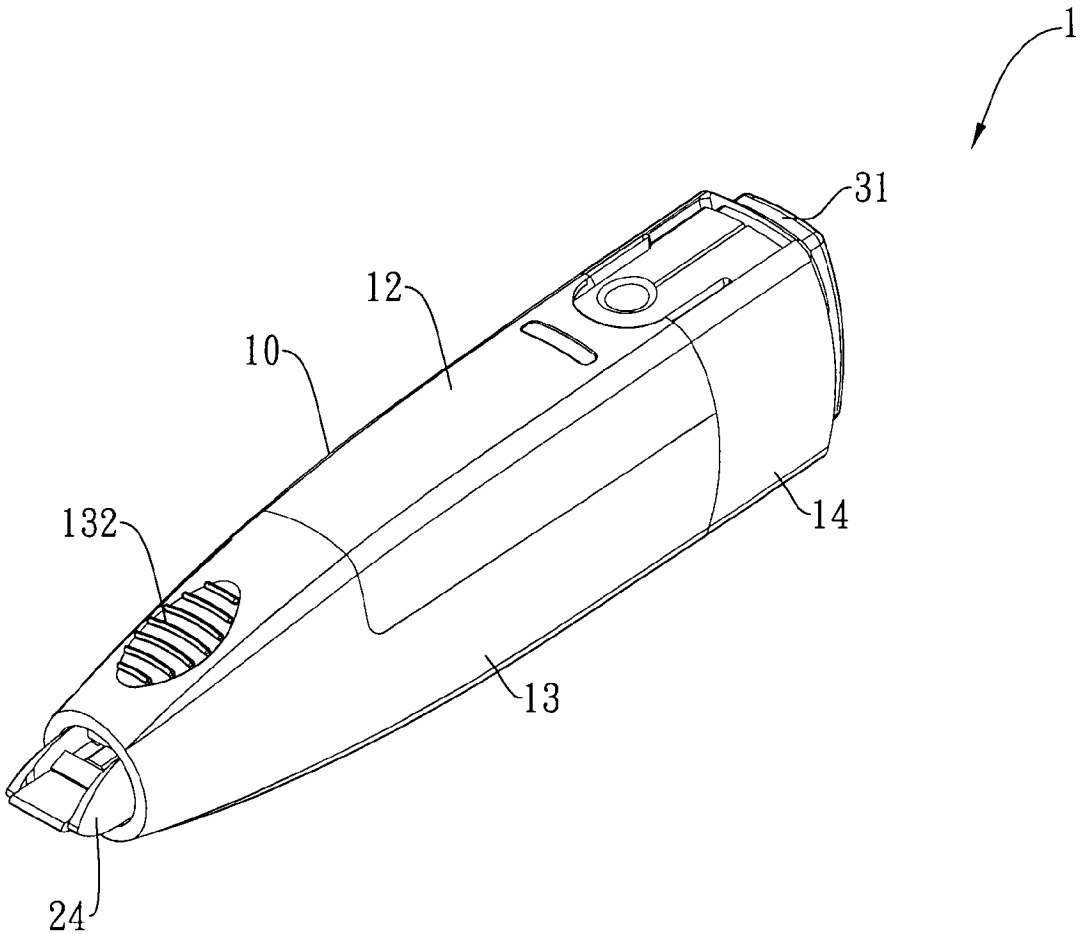
FIG. 1 is a block diagram showing the appearance of the push-button controlled correction tape of the present invention.
Figure 2:
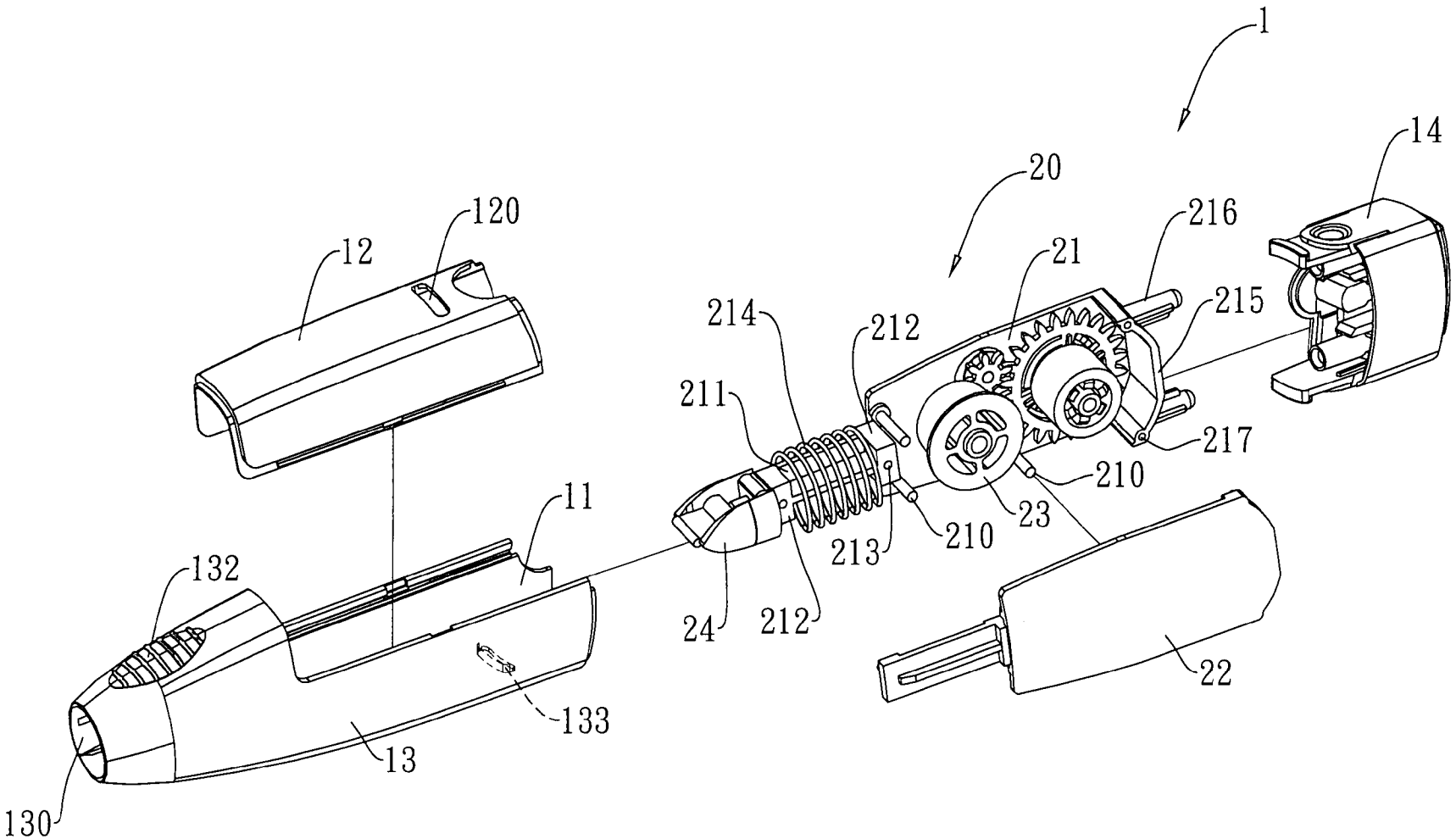
FIG. 2 is an exploded block diagram showing the parts within the push-button controlled correction tape of the present invention.

Referring to FIG. 1 and FIG. 2, which are the block diagram of the appearance of the push-button controlled correction tape of the present invention and an exploded block diagram of the push-button controlled correction tape of the present invention, the push-button controlled correction tape of the present invention comprises: a casing 10, which is provided with an accommodating space 11, as well as an upper covering 12, a lower covering 13, and an assembling covering 14; a tape holder 20, which is placed within the accommodating space 11 of the casing 10, and is provided with a first assembly 21, a second assembly 22, a correction tape exporting device 23, and an applicator head 24; and pressing mechanism 30 (referring to FIG. 4A and FIG. 4B), which is placed on one side of the rear covering of the casing 10, and is provided with a pressing portion 31, a fixing block 32, a guiding block 33, and a sliding bar 34.

The front side of the lower covering 13 is a blocked structure while the rear side is a semi-opened structure, and the front end of the blocked structure is provided with a circular opening 130, and the two sides of the inner walls of the blocked structure are provided with a pair of symmetrically placed poles 131 (referring to FIG. 5 and FIG. 6), and the upper side of the blocked structure is provided with an anti-sliding portion 132, while the rear side of the semi-opened structure is provided with a buckling hole 133. The upper covering 12 is placed on the upper end of the lower covering 13, and assembles with the lower covering 13. In addition, the upper covering 12 is a inverse U shape while being transparent, and the position corresponding to the buckling hole 133 of the lower covering 13 is also provided with a buckling hole 120. On the other hand, the assembling covering 14 is hollowed, with one side being provided with an opening 140 (referring to FIG. 4A and FIG. 4B), and one side within the inner side of the covering is provided with a bulge 141. In addition, positions corresponding to the buckling holes 120, 130 of the upper covering 12 and lower covering 13 are provided with a pair of bucklings 142, which is used to assemble the upper covering 12 and the lower covering 13.

Figure 3:
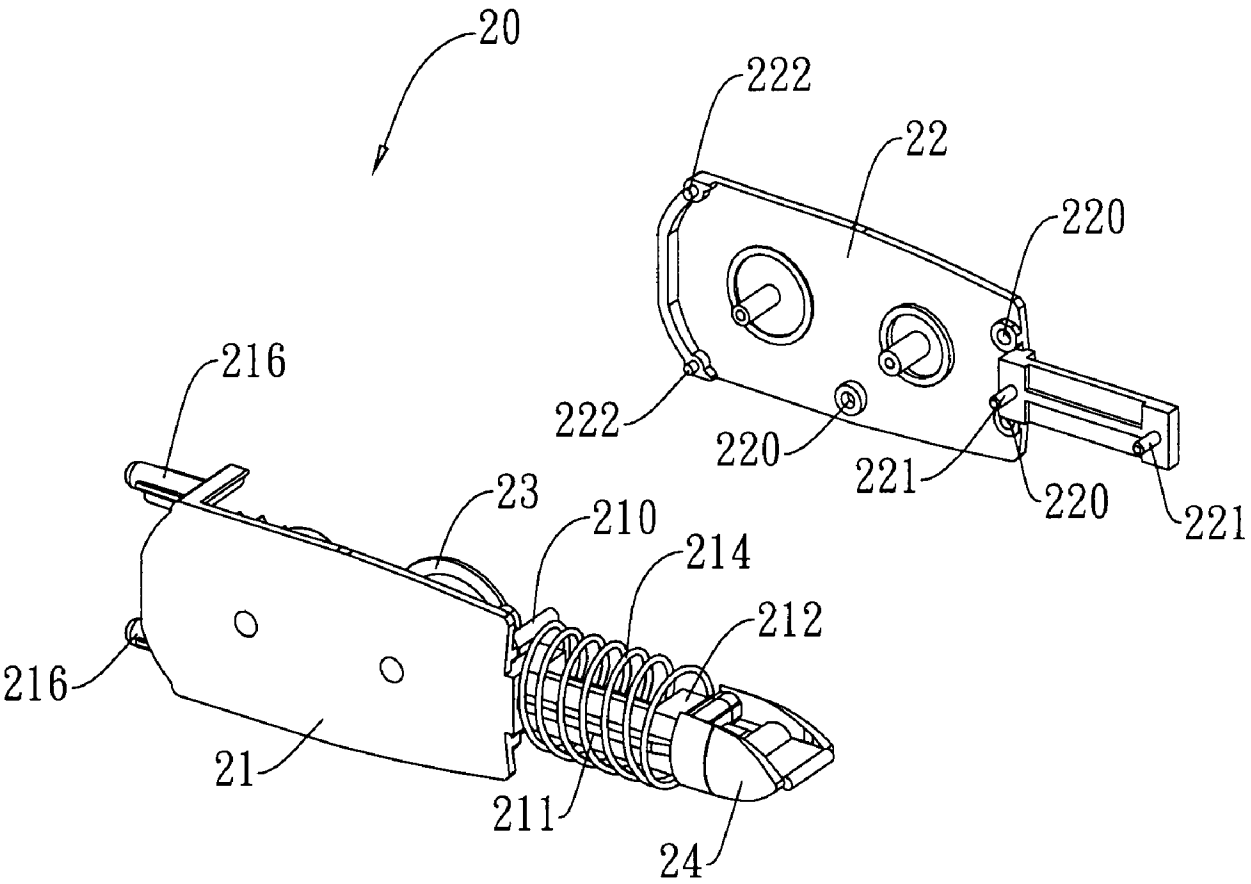
FIG. 3 is an exploded block diagram showing the tape holder of the push-button controlled correction tape of the present invention from another perspective.

Also referring to FIG. 3, which is an exploded block diagram showing the tape holder of the push-button controlled correction tape of the present invention from another perspective, the first assembly 21 and the second assembly 22 are assembled, the side of the first assembly 21 is provided with a plurality of pins 210, while the front end is provided with a straight bar 211. The two sides of the straight bar 211 are provided with a stopping portion 212, and the stopping portion 212 are provided with holes 213, while inside the straight bar 211, an elastic element 214 is provided. In the example of the present invention, the elastic element 214 is a spring, and an arc surface is extended from one side of the rear side of the first assembly 21, and a pair of poles 216 is provided on the arc surface, with holes 217 being provided on the two edges of the arc surface 215. The positions on the second assembly 22 corresponding to a plurality of pins 210 on the stopping portion of the first assembly 21 are provided with holes 220, and the positions on the second assembly 22 corresponding to the holes 213 on the stopping portion 212 of the first assembly 21 are provided with pins 221, 222. The correction tape exporting device 23 of the tape holder 20 is fixed between the first assembly 21 and the second assembly 22, and the applicator head 24 is placed on the front end of the correction tape exporting device 23.

Figure 4A:
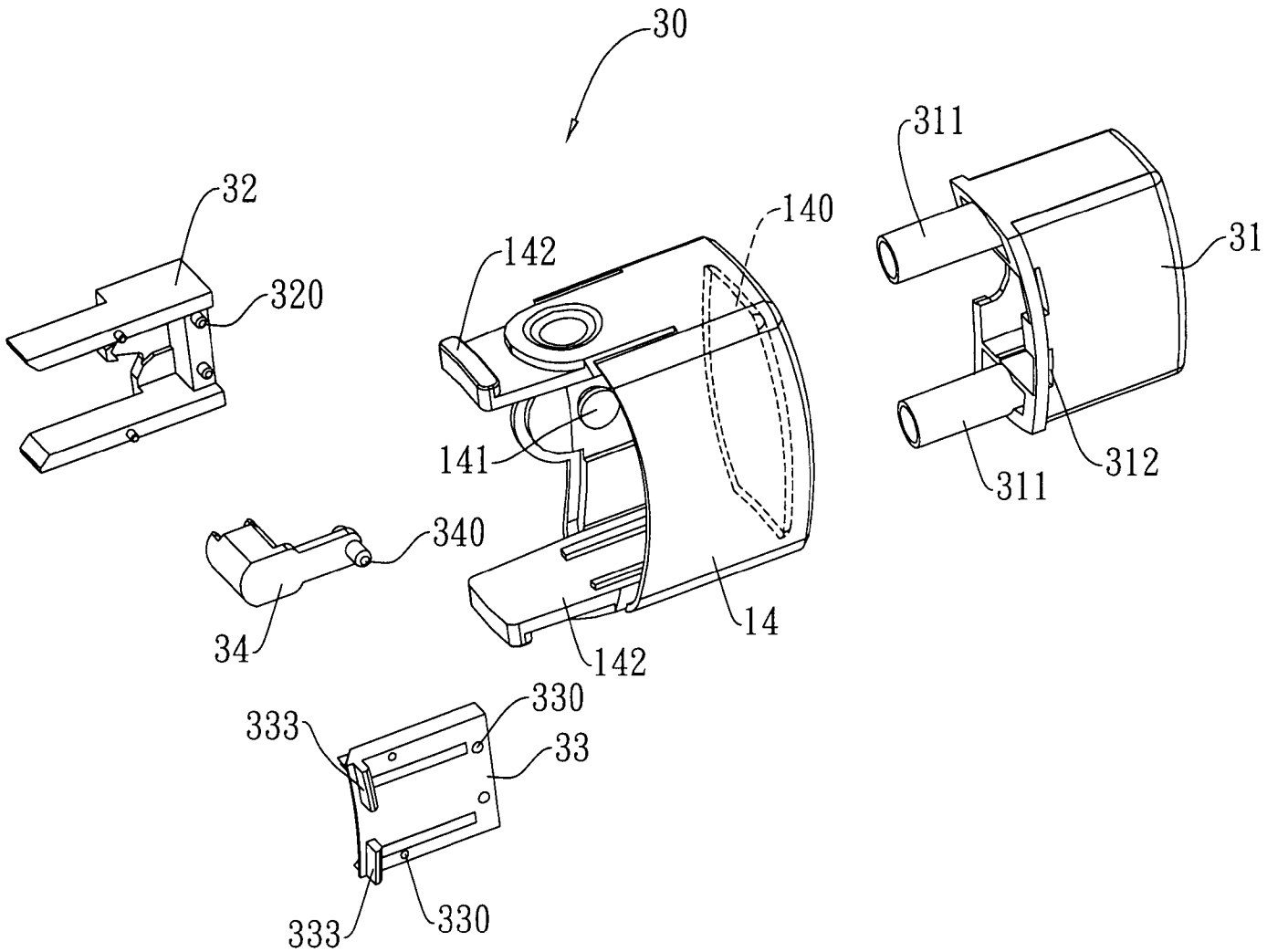
FIG. 4A is an exploded block diagram showing the pressing mechanism of the push-button controlled correction tape of the present invention.
Figure 4B:
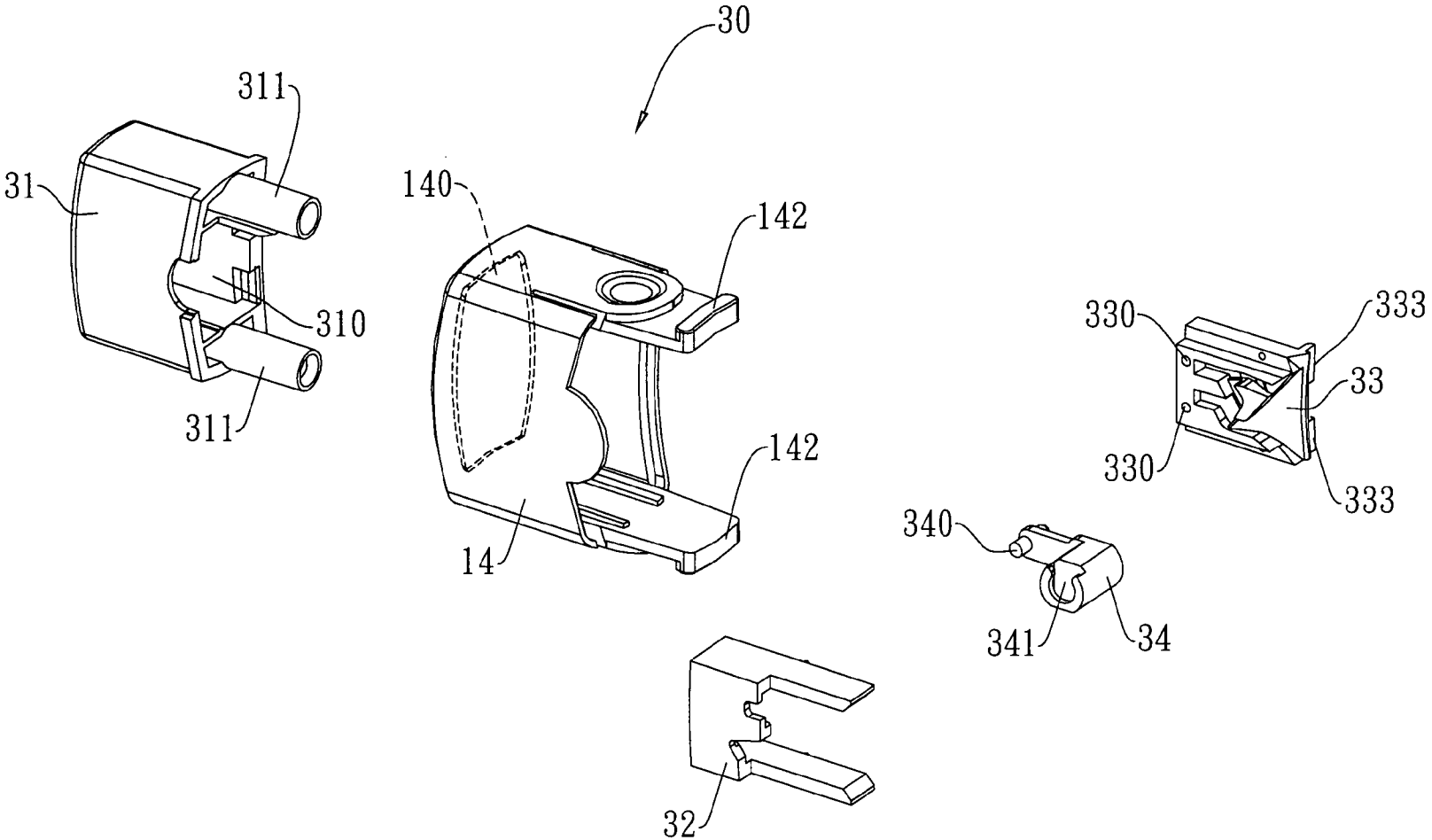
FIG. 4B is an exploded block diagram showing the pressing mechanism of the push-button controlled correction tape of the present invention from another perspective.

Referring to FIG. 4A and FIG. 4B, which are block diagrams showing the pressing mechanism of the push-button correction tape of the present invention from different perspectives, the pressing portion 31 of the pressing mechanism 30 is provided with a receiving space 210, and a pair of receiving tubes 311 are extended from the two ends of one side of the receiving space 310. The receiving tubes 311 are designed to receive the corresponding poles 216 of the first assembly 21, and the edge of one side of the pressing portion 31 is provided with a pair of bucklings 312. The fixed block 32 is provided with a plurality of poles 320, and the guiding block 33 is provided with a plurality of poles 320 corresponding to the fixed block 32. The guiding block is provided with a first guiding path 331 and a second guiding path 332, and a pair of clippings 333 corresponding to the buckling holes 312 of the pressing portion 31 are provided on one side of the guiding block 33. One end of the sliding bar 34 is provided with a guiding bar 340, while one side of another end is provided with a notch 341, and the notch 341 is used to facilitate the connection with the bulge 141 of the assembling covering 14.

When the assembling the push-button controlled correction tape of the present invention 1 is required, first of all, the correction tape exporting device 23 is placed on the first assembly 21, then the second assembly 22 is connected to the corresponding pin 210 of the first assembly 21 using the hole 220, at the same time, the pins 221, 222 of the second assembly 22 is inserted to the corresponding holes 213 on the stopping portion 212 of the first assembly 21 and the hole 217 of the arc surface 215, enabling the second assembly 22 to combine with the first assembly 21. The combined first assembly 21 and the second assembly 22 are further connected with the applicator head 24 to form the tape holder 20, followed by the assembling of the pressing mechanism 30. The pole 320 of the fixed block 32 is combined with the corresponding through hole 330 of the guiding block 33, enabling the pole 320 of the fixed block 320 to be inserted to the through hole 330 of the guiding block 33, for which the guiding bar 340 is fixed by the fixed block 32, as so during the moving process, the guiding bar 340 would not fall off easily from the guiding block 33. The combined guiding block 33 and the fixed block 32 are placed in the receiving space 310 of the pressing portion 30, and the clippings 333 of the guiding block 33 are used to buckle to the buckling hole 312 of the pressing portion 30, so the guiding block 33 and the fixed block 32 are fixed on the pressing portion 30. The receiving tubes 311 of the pressing portion 40 receive the corresponding poles 216 of the first assembly 21, so the tape holder 20 is combined with the pressing portion 31. The combined tape holder 20 and the pressing portion 31 are placed inside the lower covering 13, and the upper covering 12 is placed to cover the semi-opened structure of the lower covering 13. At this moment, the notch 341 of the sliding bar 34 receives the corresponding bulge 141 of the assembling cover 14, and the pressing portion 30 of the combined guiding block 33 and fixed block 32 is placed inside the assembling covering 14, and the clippings 142 of the assembling covering 14 are used to buckle the buckling holes 120, 133 of the upper covering 12 and the lower covering 13, in order to combine with the assembling covering 14. At this moment, the guiding bar 340 of the sliding bar 34 is placed in the first receiving space 331 of the guiding block 33, which completes the assembling of the push-button controlled correction tape of the present invention 1.

Figure 5:
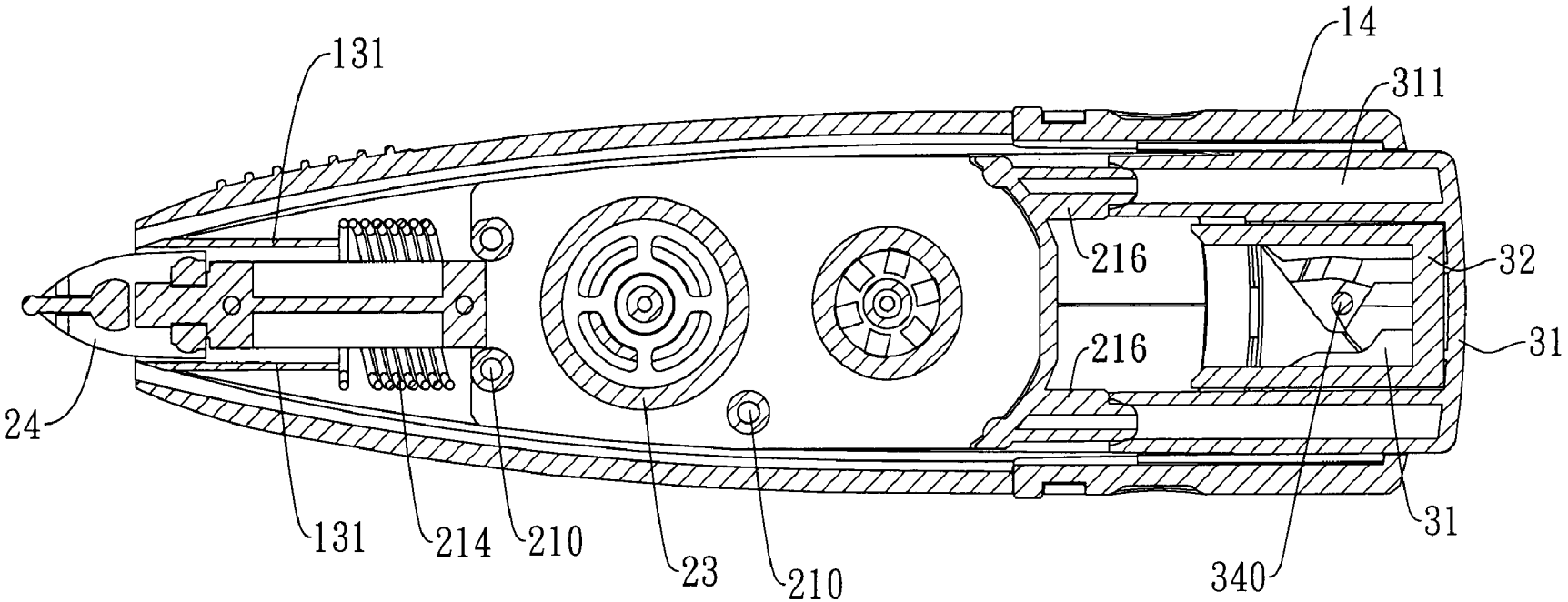
FIG. 5 is a cross-sectional diagram showing the pressing portion of the push-button controlled correction tape of present invention after pushing.
Figure 6:
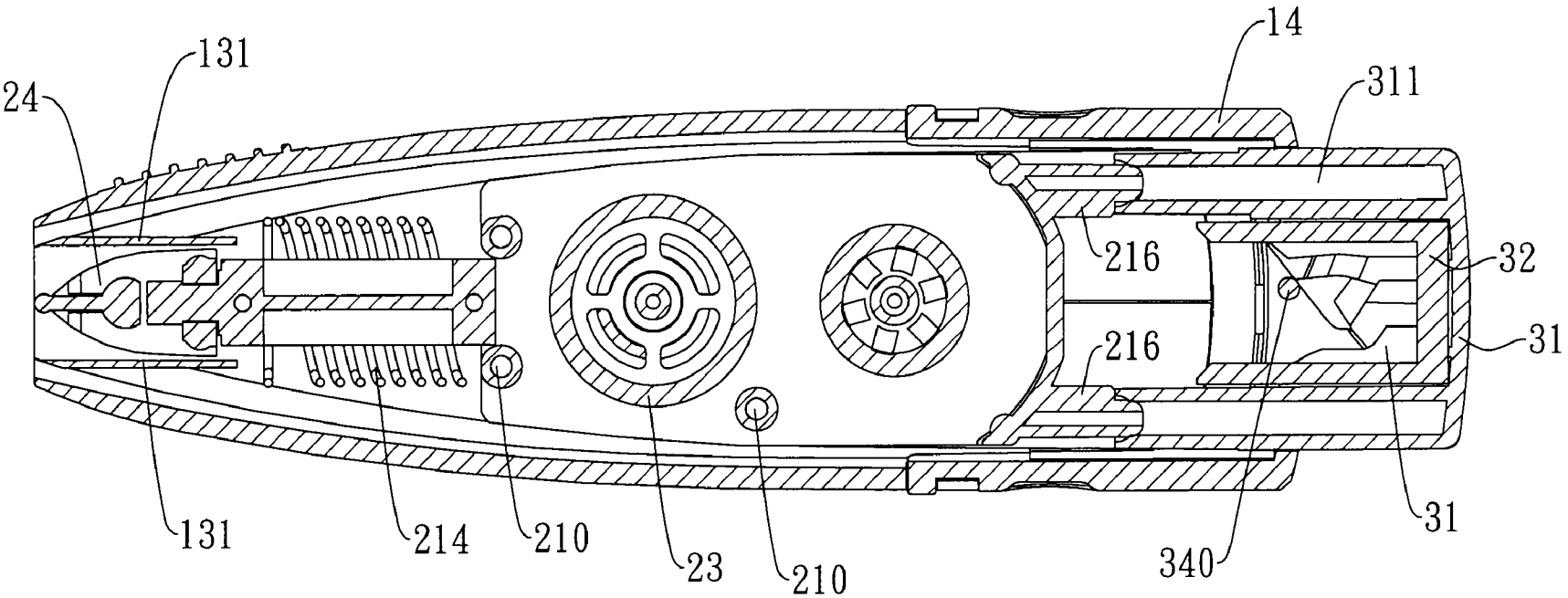
FIG. 6 is a cross-sectional diagram of the push-button controlled correction tape of the present invention before pushing.
Figure 7:
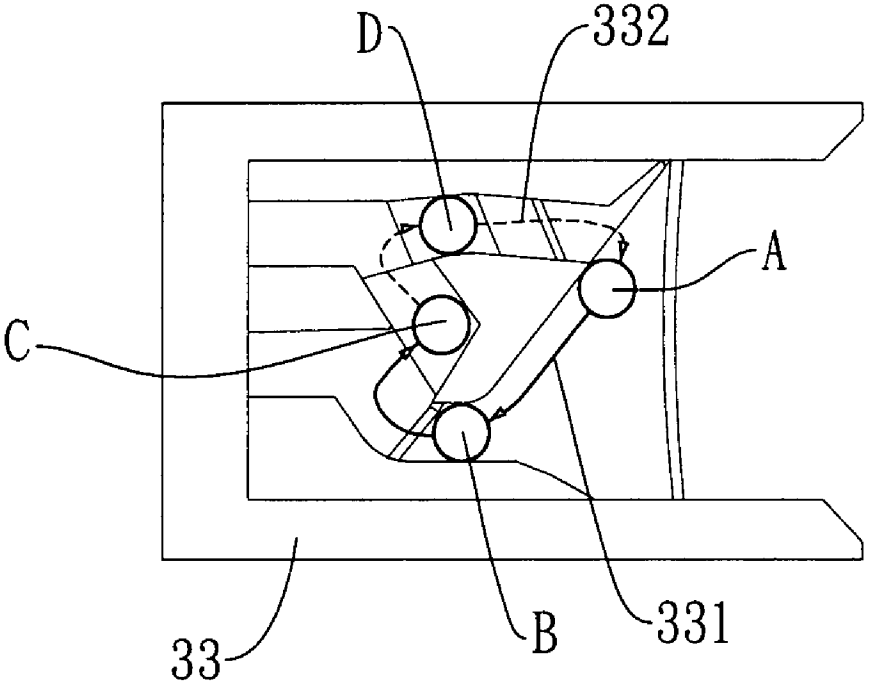
FIG. 7 is a top-view diagram of the guiding block of the push-button controlled correction tape of the present invention.

The following description is referring to FIG. 5 and FIG. 6 with FIG. 7, which is showing the cross-sectional diagram of the push-button controlled correction tape of the present invention and the top-view diagram of the push-button controlled correction tape of the present invention. The push-button controlled correction tape of the present invention 1 in a state without being pressed is as shown in FIG. 6, the applicator head 24 is placed in the casing 10. When the user is about to use the push-button controlled correction tape of the present invention 1, first of all, the pressing portion 31 is pushed, at this moment, the guiding bar 340 of the sliding bar 34 is moved to a preset position along the first guiding path 331 (following the solid line with arrow from point A to point C through point B, as shown in FIG. 7), so the receiving tubes 311 of the pressing portion 31 pushes the poles 216 of the first assembly 21 to move the tape holder 20 forwards. At this moment, since the elastic element 214 in the straight bar 211 of the correction tape exporting device 23 is held compressed by the poles 131 of the inner walls of the lower covering 13, a compression elastic force is induced, so the applicator head 24 is exposed from the circular opening 130 of the lower covering 13 (as shown in FIG. 5), for purposes of correcting the writing errors on paper using the push-button controlled correction tape of the present invention 1. When the user finishes using the push-button controlled correction tape of the present invention 1, and would like to recess the applicator head 24 in the casing 10, the pressing portion 31 is pushed again, and the guiding bar 340 of the sliding bar 34 moves back to the first guiding path 331 along the second guiding path 332 due to another push of the guiding block 33 (following the dotted line with arrow from point C back to point A through point D, as shown in FIG. 7), so the receiving tube 311 of the pressing portion 31 pushes the poles 216 of the first assembly 21, which moves the tape holder 20 forwards. At this moment, since the elastic element 214 in the straight bar 211 of the correction tape exporting device 23 is experiencing a compression force due to the push from the poles 131 of the inner wall of the lower covering 13, an elastic compression force is induced, so the applicator head 24 recesses back into the casing 10 (as shown in FIG. 6), therefore the applicator head 24 would be prevented from problems such as damages or staining due to external impact.

What is claimed is:

1. A push-button controlled correction tape, comprising:

a casing, which is provided with an accommodating space, and the rear end of the casing is provided with an opening and a bulge, while the front end is provided with a circular opening;

a tape holder, which is placed in the accommodating space of the casing, and the front end is provided with an applicator head, while the rear end is provided with a pair of poles; and a pressing mechanism, which is placed at the rear opening of the casing, and is provided with a pressing portion, a guiding block and a sliding bar, the pressing portion is provided with a receiving space, and a pair of receiving tubes are extended from two ends of one side of the receiving space in order to receive the pair of poles of the rear end of the tape holder, a pair of buckling holes are provided on the edge of one side of the pressing portion, a first guiding path is provided on the guiding block, and a pair of clippings are provided on the position on the guiding block corresponding to the buckling holes of the pressing portion in order to place the guiding block in the receiving space of the pressing portion, and one side of the sliding bar is provided with a notch in order to receive the bulge of the casing, while another end is provided with a guiding bar;

wherein by pushing the pressing portion, the guiding bar of the sliding bar would move along the first guiding path to a preset position due to the pushing of the guiding block, and the receiving tube of the pressing portion would push the poles of the tape holder, forcing the tape holder to move forwards, at this moment, the tape holder would experience a compression elastic force, causing the applicator head to expose outside the circular opening of the casing.

2. The push-button controlled correction tape according to claim 1, wherein the casing is further provided with an upper covering, a lower covering, and an assembling covering, the circular opening is provided on the upper covering, while the opening is provided on assembling covering, and the bulge is provided on one side inside the assembling covering.

3. The push-button controlled correction tape according to claim 2, wherein the front side of the lower covering is a blocked structure, while the rear side is a semi-opened structure, and the rear side of the semi-opened structure is provided with a buckling hole.

4. The push-button controlled correction tape according to claim 3, wherein the upper covering is placed on top of the lower covering to assemble with the lower covering, and the upper covering is transparent, while possessing an inversed U shape, the position corresponding to the buckling hole of the lower covering is also provided with a buckling hole.

5. The push-button controlled correction tape according to claim 4, wherein the positions on the assembling covering corresponding to the buckling holes on the upper covering and the lower covering are provided with a pair of clippings for assembling the upper and the lower coverings.

6. The push-button controlled correction tape according to claim 1, wherein the tape holder further comprises a first assembly, a second assembly and a correction tape exporting device, the correction tape exporting device is fixed between the first and the second assembly, and the applicator head is assembled with the correction tape exporting device, while a pair of poles are placed on the arc surface extended from one side of the rear side of the first assembly.

7. The push-button controlled correction tape according to claim 6, wherein the side of the first assembly is provided with a plurality of pins, and the front side is provided with a straight bar, the two sides of the straight bar are each provided with a stopping portion, holes are provided on the stopping portion, and an elastic element is provided inside the straight bar, the two edges of the arc surface are also provided with holes.

8. The push-button controlled correction tape according to claim 7, wherein the positions on the second assembly corresponding to the plurality of pins on the first assembly are provided with corresponding holes, and the positions corresponding to the holes on the stopping portion of the first assembly and the holes of the arc surface are also provided with pins.

9. The push-button controlled correction tape according to claim 7, wherein the casing is provided with a lower covering, the front side of the lower covering is a blocked structure, and two sides of the inner walls of the blocked structure are provided with a pair of symmetrically placed poles, the poles are used to stop the elastic element so a compression elastic force or a elastic recovery force would be induced during the process of pressing.

10. The push-button controlled correction tape according to claim 1, wherein the pressing portion is further provided with a fixed block, the fixed block is provided with a plurality of poles, and the guiding block is provided with a plurality of holes corresponding to the plurality of poles on the fixed block to bind the fixed block to the guiding block, so the guiding bar is fixed.

11. The push-button controlled correction tape according to claim 1, wherein the guiding block of the pressing portion is further provided with a second guiding path, the second guiding path is used to force the guiding bar of the sliding bar to recess back to the first guiding path along the second guiding path due to the pushing of the guiding block when the pressing portion is pushed again, and the receiving tubes of the pressing portion pushes the poles of the tape holder to move the tape holder forwards, so the tape holder would experience an elastic recovery force, causing the applicator head to recess back into the casing.

* * * * *